US006068560A

United States Patent [19]

DeLuca

[11] Patent Number: 6,068,560

[45] Date of Patent: May 30, 2000

[54] GOLF CLUB PUTTER HEAD

[76] Inventor: Joseph H. DeLuca, 5930 Wispering Pines Way, Unit 411B2, Lake Worth, Fla. 33463

[21] Appl. No.: 09/130,558

[22] Filed: Aug. 10, 1998

[51] Int. Cl.[7] ..... A63B 53/02; A63B 53/04

[52] U.S. Cl. ..... 473/313; 473/325; 473/340

[58] Field of Search ..... 221/740; 473/324, 473/325, 340, 341, 349, 305–315, 282, 290, 219, 226, 223, 251, 252, 255, 238, 293

[56] References Cited

U.S. PATENT DOCUMENTS

| | | |
|---|---|---|
| D. 91,336 | 1/1934 | Thompson . |
| D. 209,301 | 11/1967 | Comitz . |
| D. 234,962 | 4/1975 | Swash . |
| 3,675,923 | 7/1972 | Allen . |
| 3,873,094 | 3/1975 | Sebo . |
| 3,992,015 | 11/1976 | Benson . |
| 4,010,958 | 3/1977 | Long . |
| 4,147,357 | 4/1979 | Strop . |
| 4,951,949 | 8/1990 | Kastenhuber . |
| 5,505,447 | 4/1996 | Mockovak . |
| 5,577,968 | 11/1996 | Pritchett . |
| 5,910,055 | 6/1999 | Bennett . |

OTHER PUBLICATIONS

"Golf Digest", magazine, Nov. 1975 issue, p. 98, advertisement for "The Spider" putter.

*Primary Examiner*—Sebastiano Passaniti
*Attorney, Agent, or Firm*—Barlow,Josephs & Holmes, Ltd.

[57] ABSTRACT

The putter head of the invention defines a ball striking face which is composed of a plurality spaced heads having ball engaging faces and a hosel with a plurality of fingers, each finger of which is integrally attached to a respective head section.

5 Claims, 6 Drawing Sheets

GOLF CLUB PUTTER HEAD

BACKGROUND OF THE INVENTION

The present invention relates generally to a particular category of golf equipment known as a putter. There are numerous putters on the market but there is a continuing need for improvement in the playability of a putter, particularly because many golfers hit the ball off-center of the putter face and this produces less thrust and gives the golfer inconsistent distance. That is to say, they hit it either on the heel or toe rather than dead center at the "sweet spot". Statistically, it is stated that the ball is hit off the "sweet spot" at least 60% of the time. In the prior art, various techniques have been used to design putters for improved performance. Most of these involve the insertion of weights or screws into bores in the putter head in positions that may be adjustable prior to play. For example, the Dingle et al. U.S. Pat. No. 5,429,356, discloses a golf putter with a solid face with three shafts protruding rearwardly therefrom to which may be attached various weights or washers that will produce a sweet spot at a predetermined position on the club face.

SUMMARY OF THE INVENTION

The present invention discloses a golf putter head which has a unitary hosel connected to a shaft with a plurality of spaced fingers extending from the hosel, the terminals of each finger connected to a different head section. The head sections are based from an adjacent section on the order of 1.6 centimeters. The novel feature of this arrangement is that no matter where one hits the ball, whether on the heel or toe or center, there is a consistent distance to the ball because each one of the putter head sections produces the same velocity to the ball; something that is not possible with the prior art putters where there is a single hosel connected to a unitary putter head.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which in all views the spacing between the individual heads is enlarged:

DETAILED DESCRIPTION OF THE PREFERRED EMBODIMENT

Figure 1:
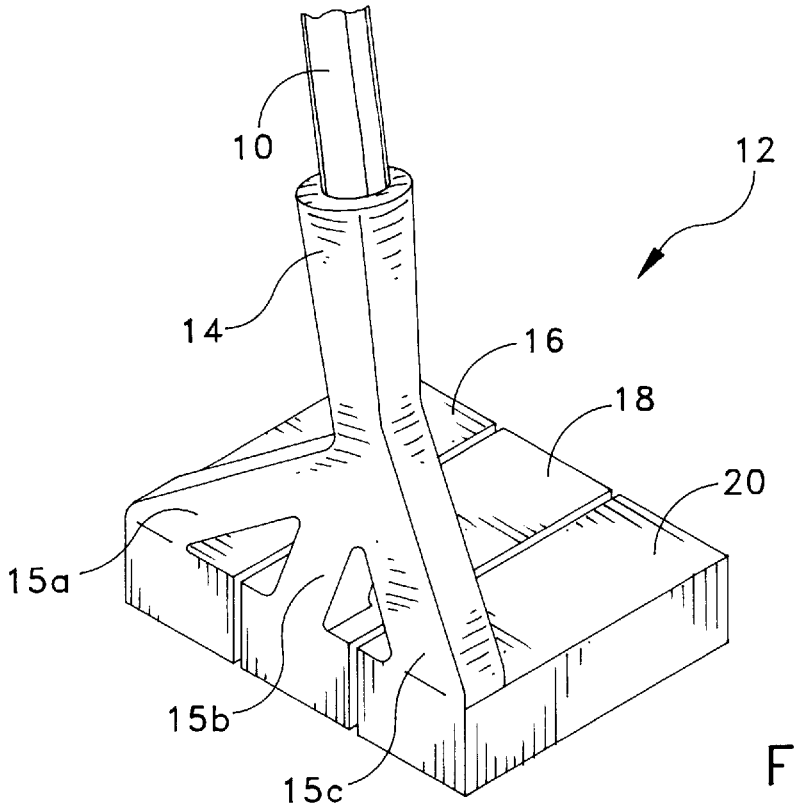
FIG. 1 is a perspective view of a golf putter head with the shaft detached in accordance with the present invention.
Figure 4:
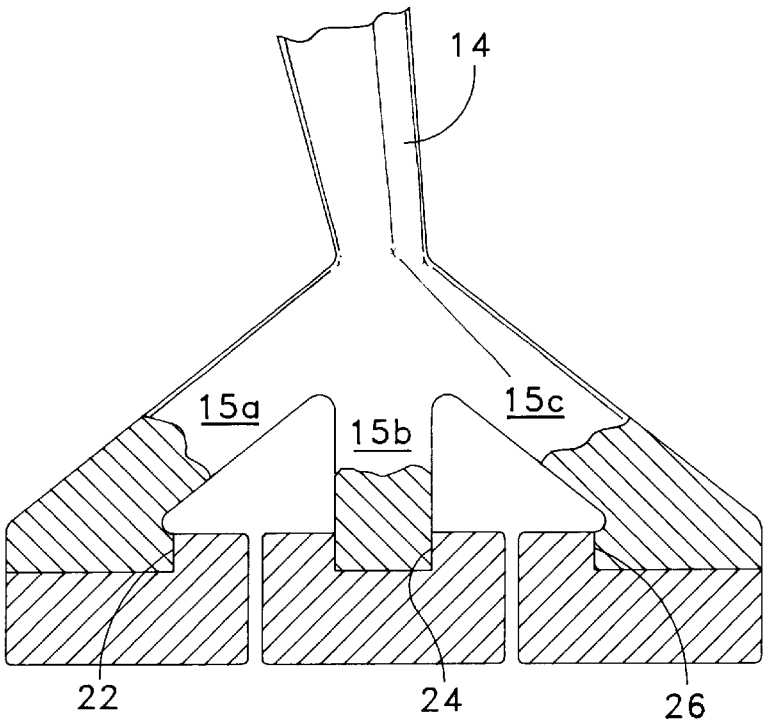
FIG. 4 is a partial sectional view taken on lines 4—4 of FIG. 3.
Figure 5:
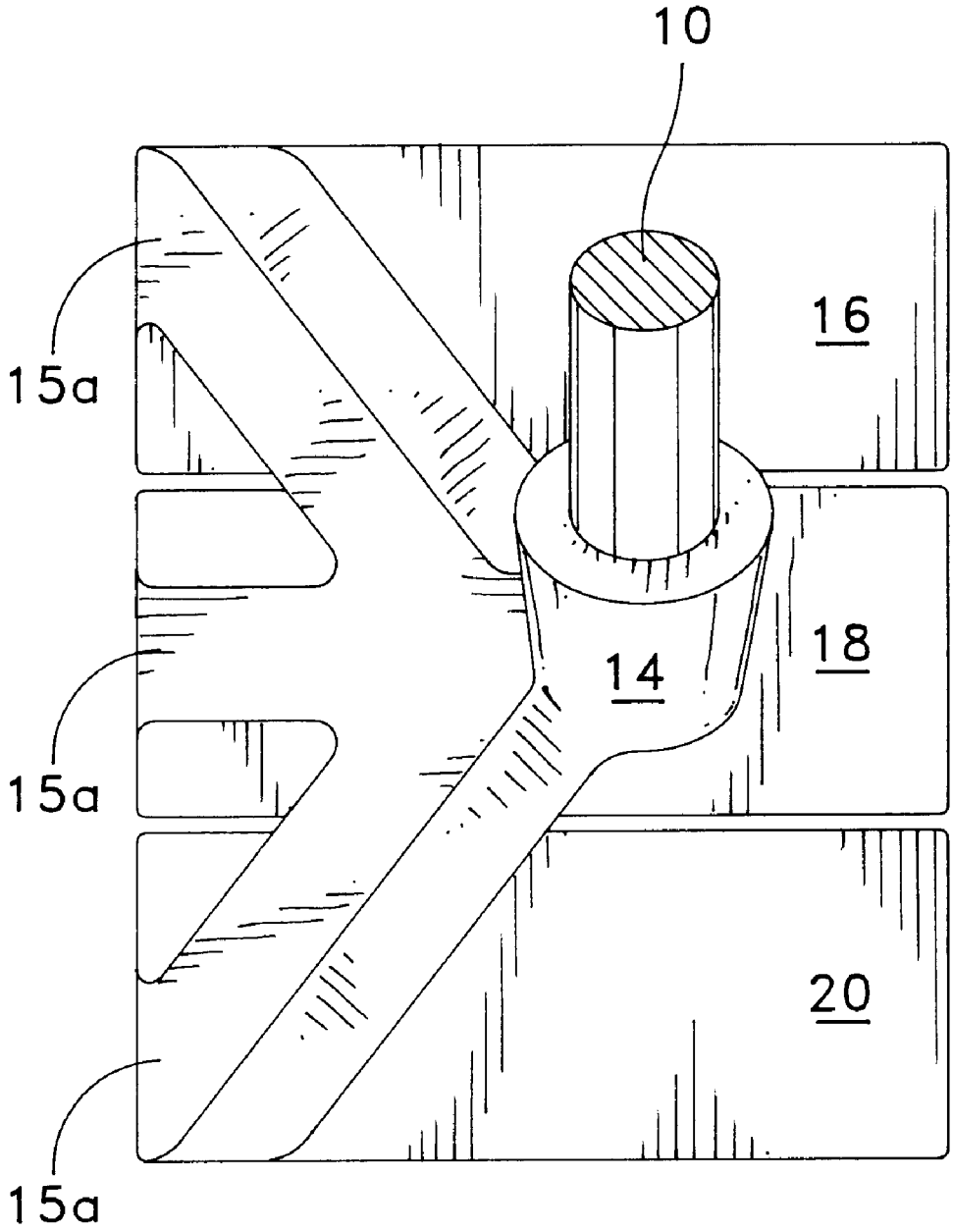
FIG. 5 is a top view of the putter head.

As seen in FIG. 1, 10 indicates a club shaft which may be of any of the well-known forms and construction and having the usual hand grip or handle portion at its upper end. Secured upon the lower end of the shaft 10 is a head 12. This head has connected to it a hosel 14 which has a plurality of fingers 15*a*, 15*b* and 15*c* connected thereto which respectively connect to head sections 16, 18 and 20. Each of the head sections 16, 18 and 20 are of substantial rectangular form and are separated from each other by a dimension on the order of 1.6 centimeters. As will be seen, each of the head sections are firmly connected to the main hosel 14 by the finger sections and a preferably manner of connecting the fingers to the head sections is seen best in FIG. 4 where the head sections 16, 18 and 20 are provided with recesses 22, 24 and 26 into which protrusions of the fingers 15*a*, 15*b*, 15*c*, respectively, are secured by any suitable means known well to those skilled in the art.

Figure 2:
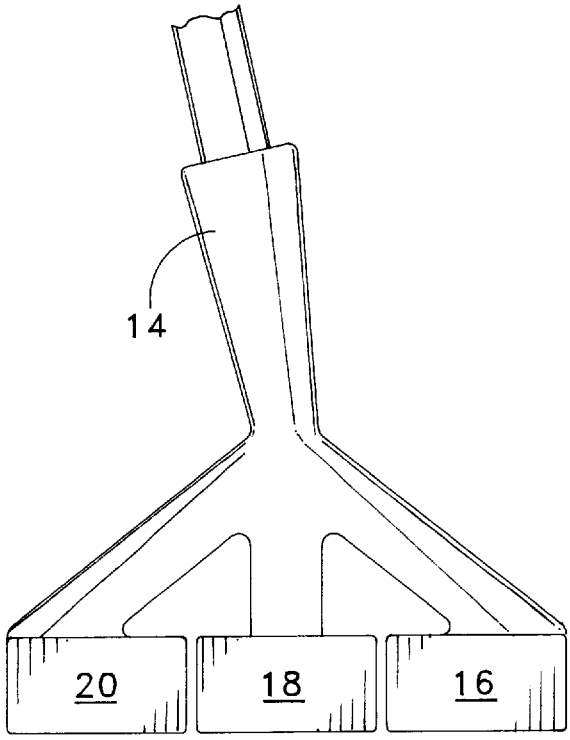
FIG. 2 is a view of the face of the putter head of FIG. 1.

Referring to FIG. 2, the faces, generally designated 21, of the putter head sections 16, 18 and 20 are seen as well as the finger 15*a*, 15*b*, and 15*c* that connect to the hosel 14. It would be apparent to anyone who has used a putter that as the force is applied from the shaft through the hosel that that force will be transmitted equally to each of the sections 16, 18 and 20. A putter head may have a velocity of somewhere around 8 to 15 feet per second and, when the golf ball is hit, whether it be by the heel or the toe, it has been proven by experimentation that the ball will indeed travel substantially an equal distance given the same velocity that is imparted to the shaft and transmitted to the putter head by the player. It would appear that with most putters, there is a deflection or twisting of the putter head on impact so that if it be with the head or the toe, various velocities will be impacted. In other words, the putter fails to be contacted by the sweet spot which normally is at the center of the putter in most putter heads. Some people feel that if a ball is contacted more than one-half inch from the sweet spot, putts greater than ten feet or so will miss sixty percent of the time. The instant invention with equal velocity being impacted to the ball would prevent that from occurring.

Figure 3:
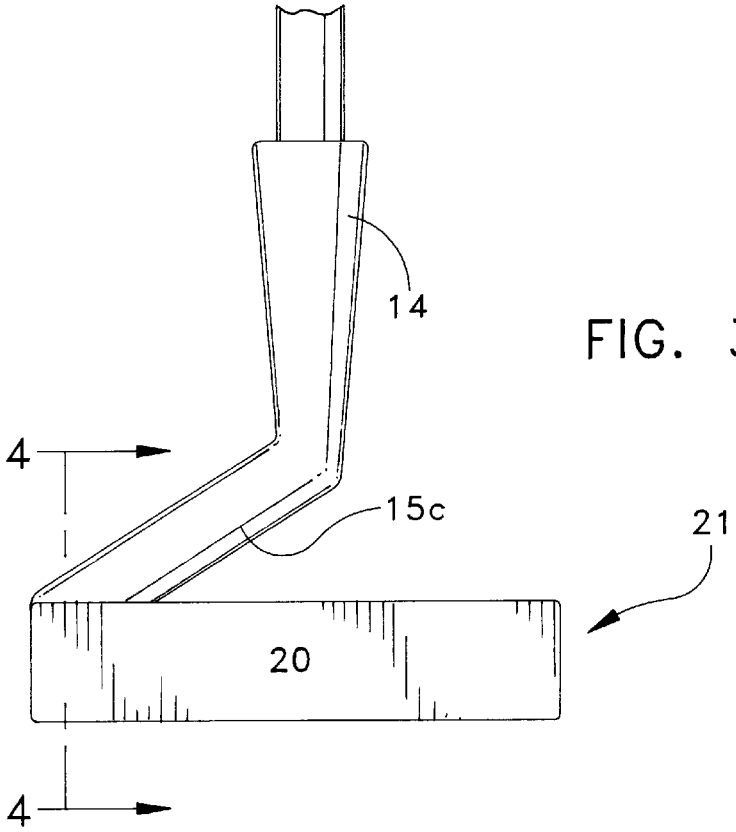
FIG. 3 is a side view of the putter head.

Referring to FIG. 3, it will be apparent that the ball contacting faces 21 of the head 12 are planar, that is to say they are straight or flat and are arranged such that they are generally parallel with the longitudinal axial plane of the shaft 10. The arrangement is such that when the face strikes the ball, it is essentially at right angles to the desired line of drive and will drive the ball along that desired line.

Figure 6:
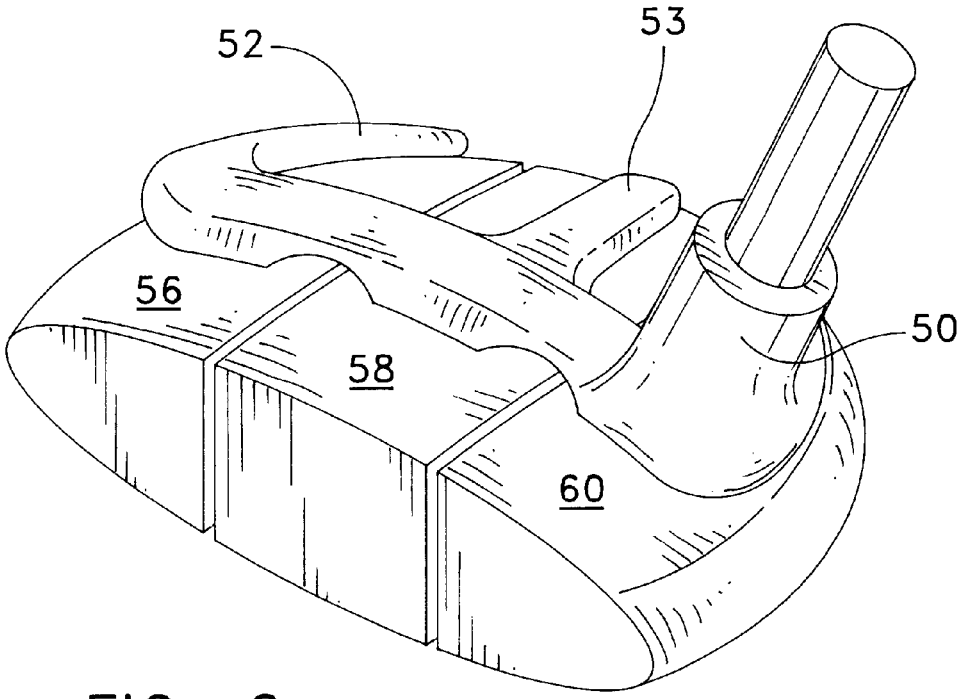
FIG. 6 is a perspective view of an alternative embodiment of the putter head embodying the same principles of the invention.
Figure 7:
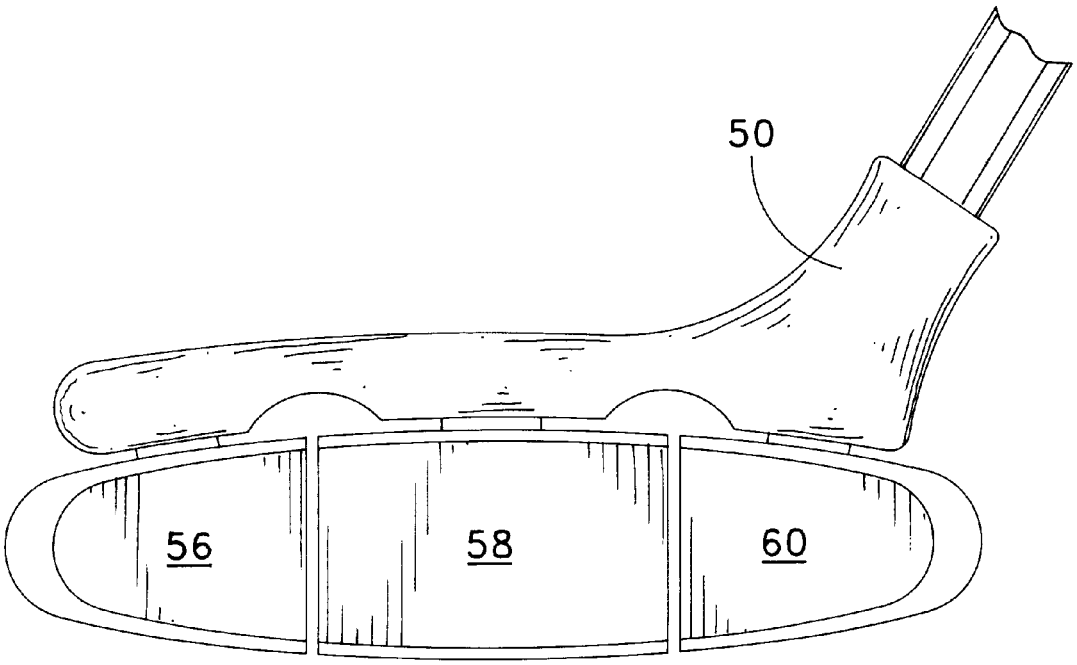
FIG. 7 is a view of the face of the putter of FIG. 6.
Figure 8:
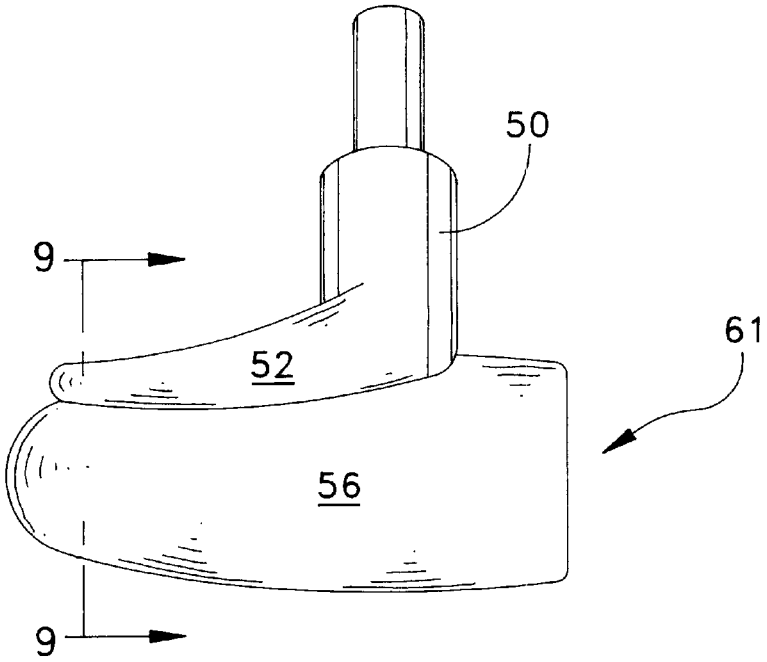
FIG. 8 is an end view of the alternate embodiment putter.
Figure 9:
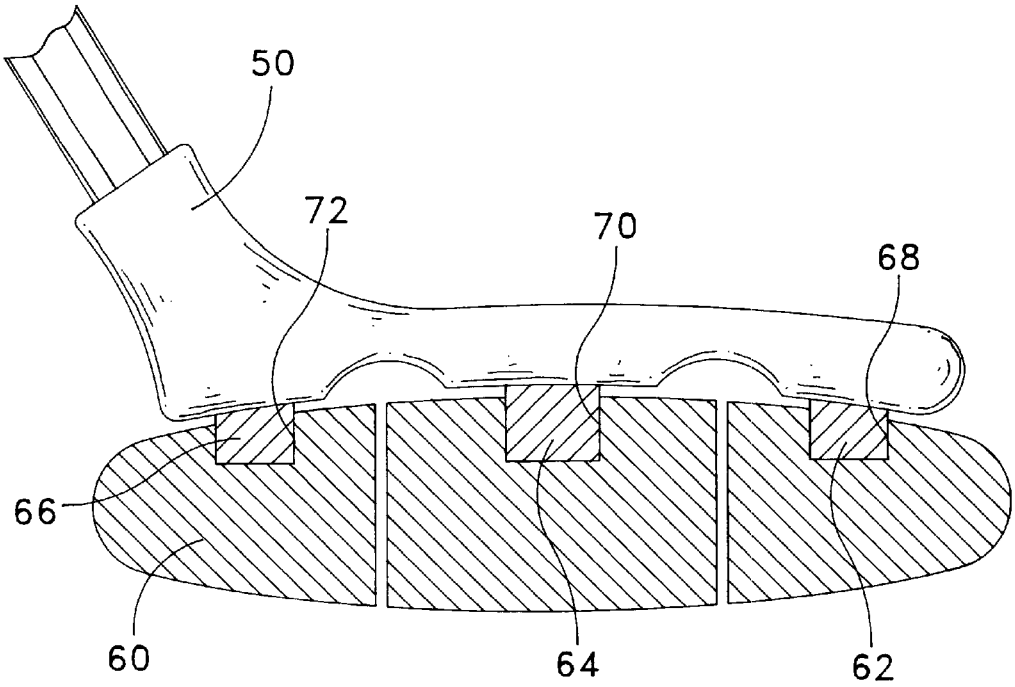
FIG. 9 is a sectional view taken on lines 9—9 of FIG. 8.
Figure 10:
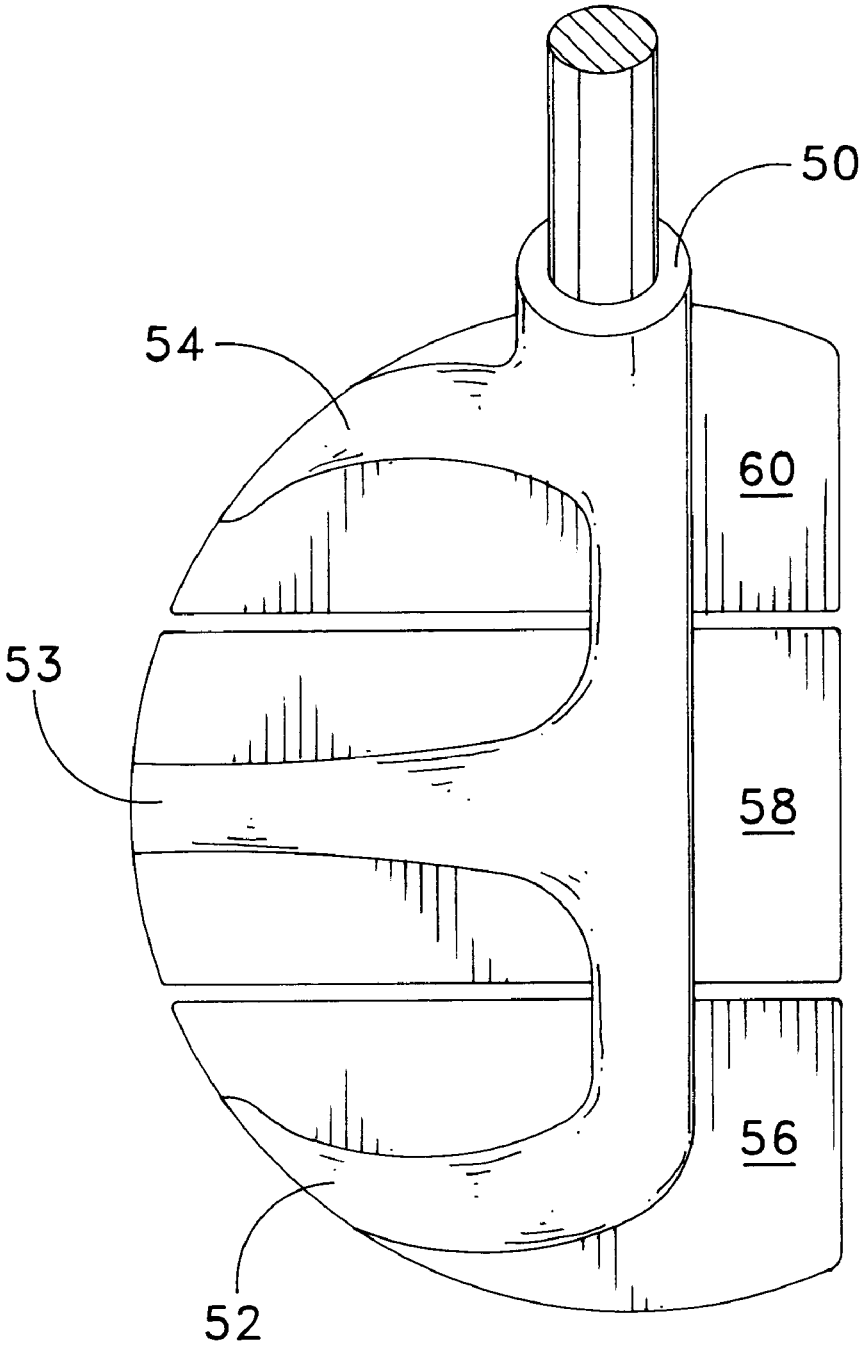
FIG. 10 is a top view of the alternate form of the putter.

Referring to FIGS. 6 and 7, a modified form of the putter head has been illustrated in which case we find that the hosel 50 is not in the center of the head but is offset. It has, as in the previous embodiment, a plurality of fingers 52, 53 and 54, which are connected, as in the previous embodiment, to sections of the putter head respectively at 56, 58 and 60. Each of these sections is slightly arcuate in one plane to produce top and bottom surfaces with a pleasing shape, but in all other aspects, the arrangement is virtually similar. The ball engaging faces, generally designated 61, of each of the sections 56, 58, 60, as seen in FIG. 8, are planar. As in the previous embodiment, each of the fingers are connected to their respective sections in a preferred manner of having protrusions such as 62, 64 and 66 that extend into recesses 68, 70 and 72 and being suitably secured therein. As in the previous embodiment, the force imparted from the hosel and the shaft is imparted equally to each of the sections of the putter and likewise, the force being imparted to the ball, whether it be at the heel, toe or alleged sweet spot in the center, will be equal and, as seen by experimentation on putting greens, the balls travel in substantially the same distance no matter which part of the putter head they are hit.

It would be apparent from the above description that the club putter head is essentially weight distributed in such a way that striking the ball off-center of the face of the head, either toward the heel or the toe, will make little difference as to the performance of the ball since the force being imparted through the hosel and its fingers is distributed in such a way that they effectively become equal. While the preferred embodiments of the present invention have been shown and described, many modifications may be made by a person skilled in the art without departing from the spirit and scope of the present invention.

What is claimed is:

1. A mallet-type putter comprising: a unitary hosel for connection to a shaft, a plurality of spaced fingers extending from the hosel, a plurality of adjacently located putter head sections for contacting a golf ball, a terminus of each said finger connected to a respective one of said putter head sections; each said section separated and spaced apart from an adjacent said section by a finite amount, whereby at least one of said sections moves independently and uniformly with remaining adjacent said sections to impart substantially the same velocity to a struck golf ball.

2. A mallet type putter as in claim 1 wherein each of the putter head sections are rectangular.

3. A mallet type putter as in claim 1 wherein each of the putter head sections has an arcuate top and a bottom side with a flat end face.

4. A mallet type putter as in claim 1 wherein the terminus of the fingers have protrusions and the putter head sections have recesses into which the protrusions are received and secured.

5. A mallet type putter as in claim 1 wherein the spacing between each putter head section is on the order of 0.63 inch (1.6 cm).

* * * * *